US010436476B2

(12) United States Patent
Boros et al.

(10) Patent No.: US 10,436,476 B2
(45) Date of Patent: Oct. 8, 2019

(54) MOTOR/DAMPER ASSEMBLY FOR FUEL-FIRED WATER HEATER

(71) Applicant: Rheem Manufacturing Company, Atlanta, GA (US)

(72) Inventors: Jozef Boros, Montgomery, AL (US); Hector Donastorg, Waverly, AL (US); Ashwin Rao, Montgomery, AL (US); Cory Allan Weiss, Warren, MI (US)

(73) Assignees: Rheem Manufacturing Company, Atlanta, GA (US); Field Controls, LLC, Kinston, NC (US)

( * ) Notice: Subject to any disclaimer, the term of this patent is extended or adjusted under 35 U.S.C. 154(b) by 246 days.

(21) Appl. No.: 15/394,945

(22) Filed: Dec. 30, 2016

(65) Prior Publication Data

US 2017/0108241 A1 Apr. 20, 2017

Related U.S. Application Data

(63) Continuation of application No. 13/196,016, filed on Aug. 2, 2011.

(60) Provisional application No. 61/379,026, filed on Sep. 1, 2010.

(51) Int. Cl.

| | |
|---|---|
| ***F24H 1/00*** | (2006.01) |
| ***F24H 9/00*** | (2006.01) |
| ***F24H 1/20*** | (2006.01) |
| ***F24H 9/18*** | (2006.01) |

(52) U.S. Cl.

CPC ..... *F24H 9/0031* (2013.01); *F24H 1/205* (2013.01); *F24H 9/1836* (2013.01)

(58) Field of Classification Search

None

See application file for complete search history.

(56) References Cited

U.S. PATENT DOCUMENTS

| | | | | |
|---|---|---|---|---|
| 3,090,558 | A | 5/1963 | Vaughn | |
| 4,102,629 | A * | 7/1978 | Feinberg | F23L 11/005 126/285 B |
| 4,213,477 | A | 7/1980 | Velasquez | |
| 4,251,024 | A | 2/1981 | Feinberg | |

(Continued)

OTHER PUBLICATIONS

U.S. Craftmaster, "Energy Effiient Gas Water Heaters" Copyright 2010-2013, 2 pgs.

(Continued)

*Primary Examiner* — Steven B McAllister
*Assistant Examiner* — John E Bargero
(74) *Attorney, Agent, or Firm* — King & Spalding LLP

(57) ABSTRACT

A motor/damper assembly installable on the top end of a fuel-fired water heater includes a support plate structure upon which a flue collar with a pivotally supported flue damper, a drive motor, and a drive shaft interconnecting the motor damper are mounted. The assembly is installed by placing the collar over the upper end of the water heater flue, securing the support plate structure to the top end of the water heater, and positioning a top cover housing on the support plate structure. Using the assembly provides improved support rigidity and alignment for the motor and shaft relative to the damper, improved repeatable precise manufacturing placement of the motor and shaft, improved construction aesthetics, with the cover also protecting the shaft from shipping and handling damages.

20 Claims, 5 Drawing Sheets

(56) References Cited

U.S. PATENT DOCUMENTS

| | | | | |
|---|---|---|---|---|
| 4,846,400 | A | 7/1989 | Crouse | |
| 5,280,802 | A | 1/1994 | Comuzie, Jr. | |
| 5,797,358 | A * | 8/1998 | Brandt | F24H 9/2035 122/448.1 |
| 5,881,806 | A | 3/1999 | Rudd | |
| D409,073 | S | 5/1999 | Bluestone | |
| 6,035,849 | A | 3/2000 | Bluestone | |
| 6,082,704 | A * | 7/2000 | Grinbergs | F24F 13/1486 251/306 |
| 6,409,143 | B1 | 6/2002 | Beck et al. | |
| 6,431,268 | B1 | 8/2002 | Rudd | |
| 6,439,877 | B1 | 8/2002 | Weiss | |
| 6,557,501 | B2 | 5/2003 | Hughes | |
| 6,644,957 | B2 | 11/2003 | Weiss | |
| 6,745,724 | B2 | 6/2004 | Hughes et al. | |
| 6,749,124 | B2 | 6/2004 | Weiss | |
| 6,749,125 | B1 | 6/2004 | Carson et al. | |
| 6,855,050 | B2 | 2/2005 | Gagnon et al. | |
| 6,915,799 | B2 | 7/2005 | Weiss | |
| 7,258,280 | B2 | 8/2007 | Wolfson | |
| 7,451,759 | B2 | 11/2008 | Weiss | |
| 7,721,972 | B2 | 5/2010 | Bracken et al. | |
| 8,113,823 | B2 | 2/2012 | Guzorek | |
| 8,297,524 | B2 | 10/2012 | Kucera et al. | |
| 2003/0075118 | A1 | 4/2003 | Lannes et al. | |
| 2005/0066958 | A1 | 3/2005 | Guzorek | |
| 2009/0277399 | A1 | 11/2009 | Guzorek et al. | |
| 2010/0012048 | A1 | 1/2010 | Whitford et al. | |
| 2013/0048743 | A1 | 2/2013 | Kucera et al. | |

OTHER PUBLICATIONS

Canadian Patent Application No. 2750181, Office Action dated Jun. 6, 2013, 3 pgs.

Residential Gas Water Heater with the Flame Lock® Safety System Installation Instructions and Use & Care Guide, Sep. 2010, 32 pgs.

* cited by examiner

MOTOR/DAMPER ASSEMBLY FOR FUEL-FIRED WATER HEATER

CROSS-REFERENCE TO RELATED APPLICATION

The present application is a continuation of U.S. patent application Ser. No. 13/196,016 filed Aug. 2, 2011 which claims the benefit of the filing date of provisional U.S. patent application No. 61/379,026 filed Sep. 1, 2010. The entire disclosure of both applications are hereby incorporated herein by this reference.

BACKGROUND OF THE INVENTION

In representatively illustrated embodiments thereof, this invention provides specially designed motor/damper apparatus for a fuel-fired liquid heating apparatus, such as a fuel-fired water heater, and a liquid heating apparatus operatively incorporating the motor/damper apparatus.

The primary purpose of the present invention is to improve the performance, construction and appearance of a motorized damper assembly used in conjunction with a fuel-fired water heater or other type of fuel-fired liquid heating apparatus such as, for example, a fuel-fired boiler. Traditional motorized flue damper assemblies, particularly for commercial fuel-fired water heaters, are constructed as two separate units comprising a drive system and an associated damper plate joined together by a steel channel such that the damper plate portion of the assembly is cantilevered from the drive system.

This conventional motor/damper assembly tends to be bulky and not particularly well suited, either from a structural or aesthetic standpoint, for residential water heaters. Some of the structural problems present in this conventional motor/damper assembly design include skewing of the damper plate that creates misalignment of and leakage around the damper plate, bending of the motor shaft or rod in shipping and handling, and providing the motor/damper assembly with a less than aesthetically pleasing appearance when installed on a residential water heater.

A need thus exists for an improved motor/damper assembly which eliminates or at least substantially alleviates these problems, limitations and disadvantages commonly associated with motor/damper assemblies of the conventional type generally described above. It is to this need that the present invention is primarily directed.

DETAILED DESCRIPTION

Figure 1:
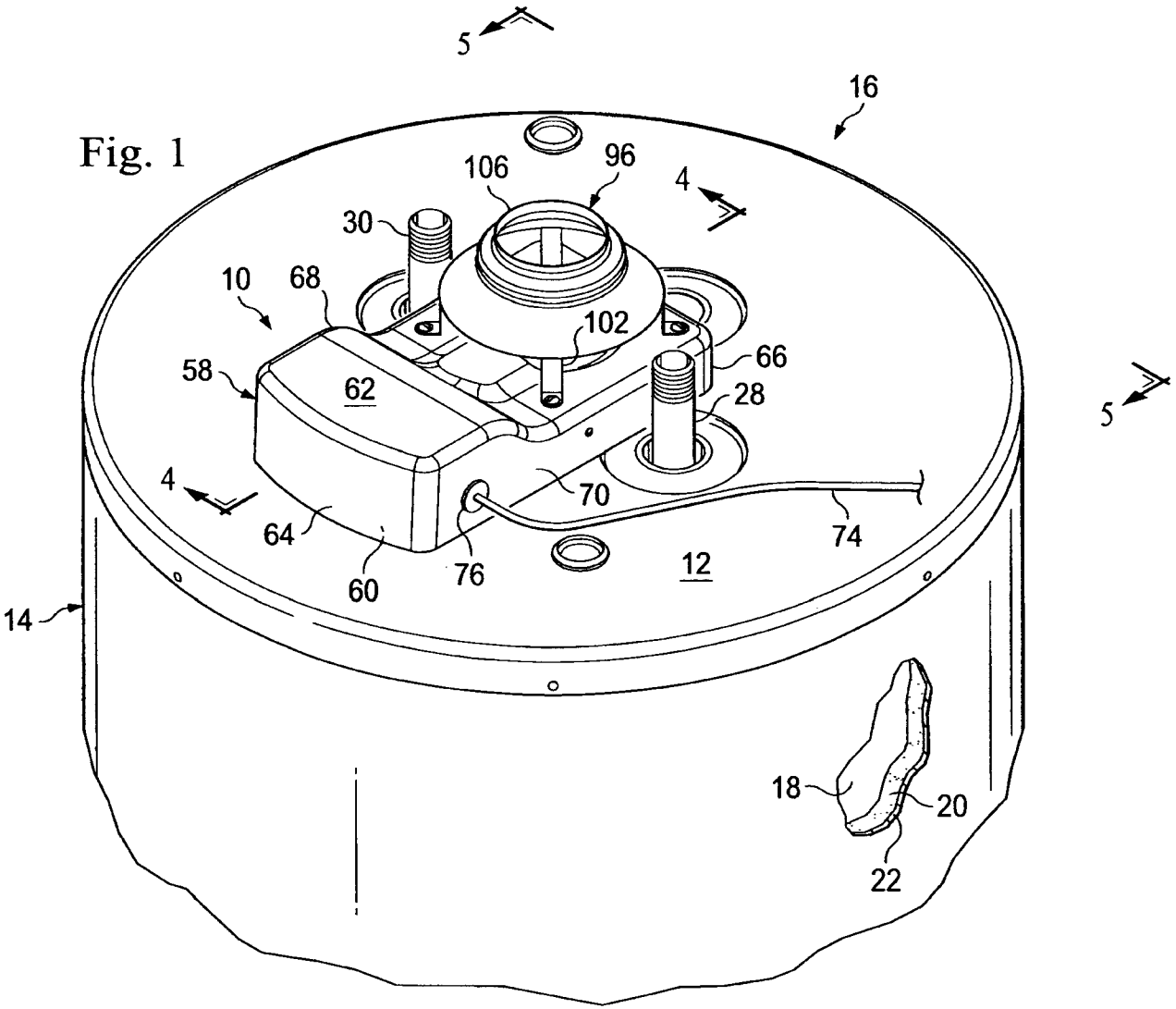
FIG. 1 is a perspective, partially cut away view of a top end portion of a representative fuel-fired water heater on a top end surface of which a motor/damper assembly embodying principles of the present invention is mounted.

As illustrated in the accompanying FIGS. 1-5, this invention provides a specially designed motor/damper assembly

10 which embodies principles of the present invention and is mountable on the top end surface 12 of the insulated hot water storage tank portion 14 of a fuel-fired water heater 16. Alternatively, the motor/damper assembly 10 could be utilized in conjunction with other types of fuel-fired liquid heating apparatus such as, for example, fuel-fired boilers. Representatively, the fuel-fired water heater 16 is a residential water heater, but could also be a commercial water heater.

Water storage tank portion 14 (see FIGS. 1 and 5) includes a vertically oriented cylindrical water storage tank 18 surrounded by a suitable insulation material 20 which, in turn, is surrounded by a metal jacket 22. Extending upwardly from the top end surface 12 of the storage tank portion 14 is a tubular exhaust flue 24 (see FIGS. 2 and 4) having an open upper end 26. During firing of the water heater 16, combustion exhaust products (not shown) are upwardly exhausted through the flue 24. Also projecting upwardly from the top end surface 12 of the storage tank portion 14 are a cold water inlet pipe 28 and a hot water outlet pipe 30 (see FIGS. 1, 2 and 5) 32 operatively coupled to the tank 18.

Figure 2:
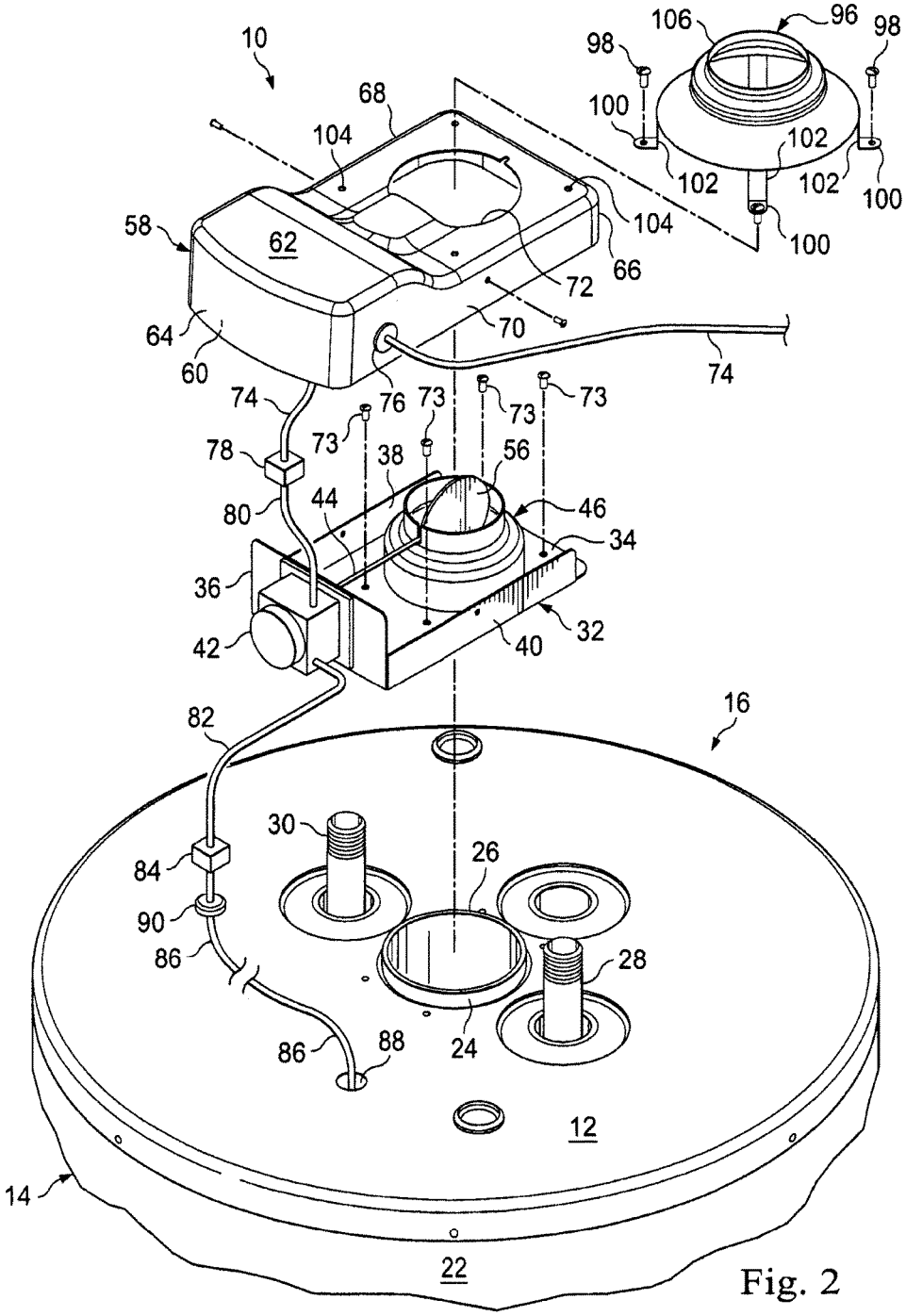
FIG. 2 is a view similar to that in FIG. 1, but with the motor/damper assembly removed from the water heater and shown in exploded perspective form.

The motor/damper assembly 10, as later discussed herein, provides several advantages over conventional motor/damper assemblies, and includes a metal support plate structure 32 (see FIGS. 2-4) having a rectangular base plate portion 34, an end plate 36 portion projecting upwardly from an end edge of the base plate portion 34, and a pair of side plate portions 38,40 projecting upwardly from opposite side edges of the base plate portion 34. Mounted on the outer side of the end plate 36, in an elevated relationship with the base plate 34, is an electric motor 42. The inner end of a horizontally oriented drive shaft 44 is drivably coupled to the motor 42. As schematically depicted in FIG. 2, the motor 42 may be incorporated in a damper control module having suitable control electronics therein which are operatively associated with the motor 42.

At the right end of the base plate 34 is an upstanding tubular collar 46 having an open lower end portion 48 complementarily received and welded within a corresponding circular opening 50 extending upwardly through the base plate 34. Collar 46 may have a reduced diameter upper end portion 52 as shown or, alternatively, the upper end portion may be of substantially the same diameter as the rest of the collar 46. An outer end portion of the drive shaft 44 extends through an upper end slot 54 in the upper collar end portion 52 and is drivingly coupled to a disc-shaped damper plate 56 which is received in the open upper end portion 52 of the collar 46 and rotatable by the motor 42 between a fully open vertical position (see FIGS. 2-4) and a fully closed horizontal position (not shown).

Figure 3:
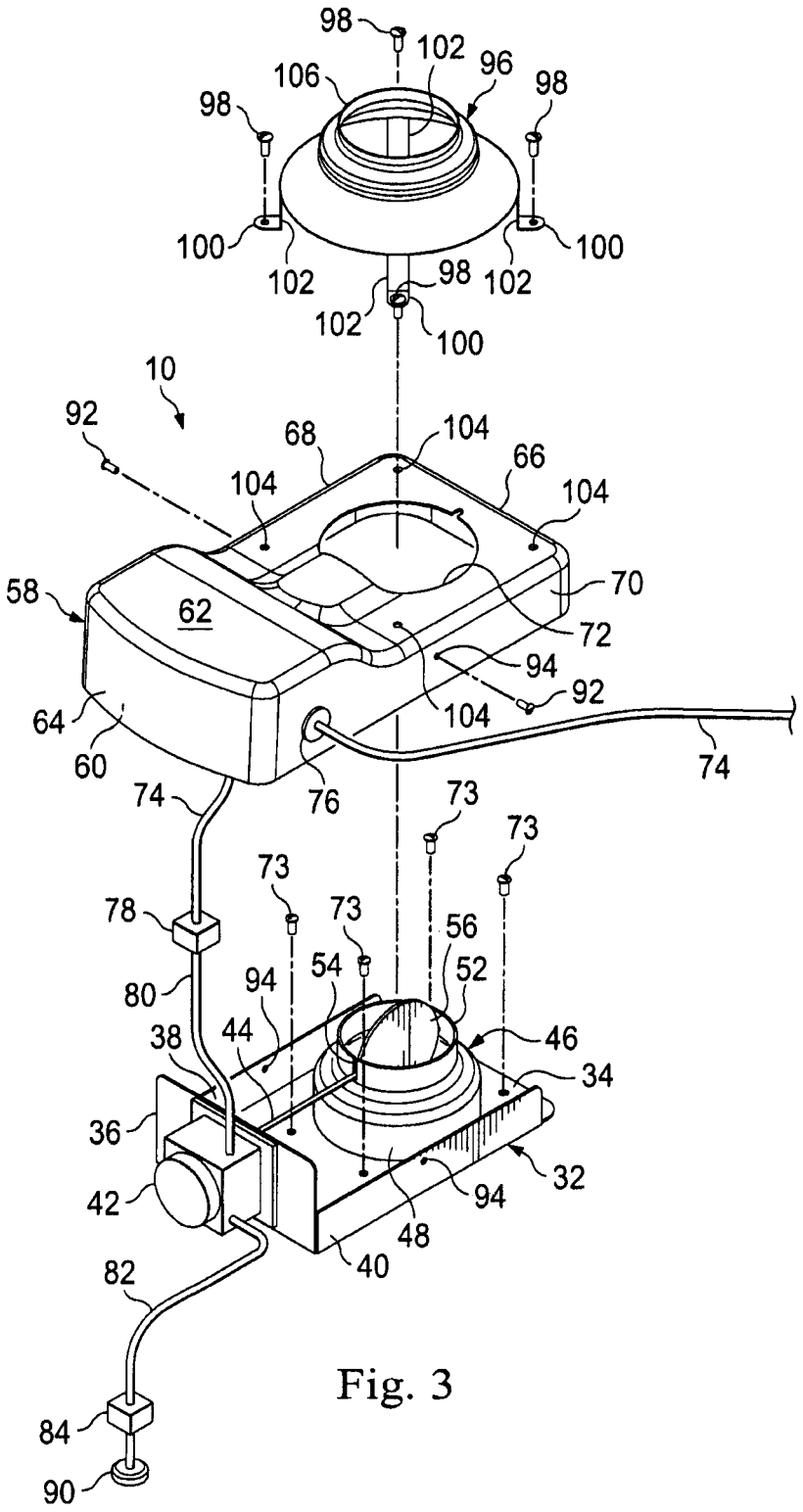
FIG. 3 is an enlarged scale exploded perspective view of the motor/damper assembly.

The motor/damper assembly 10 further includes a hollow cover structure or housing 58 (see FIGS. 1-5) having an elongated, generally rectangular shape, an open bottom side 60, a top side wall 62, a left end wall 64, a right end wall 66, a left side wall 68, a right side wall 70, and a circular opening 72 formed in the top side wall 62 and configured to complementarily receive the open end portion 52 of the tubular collar 46 as later described herein. As best illustrated in FIGS. 3 and 4, a left end portion of the housing 58 is vertically enlarged relative to the balance of the housing 58.

Figure 4:
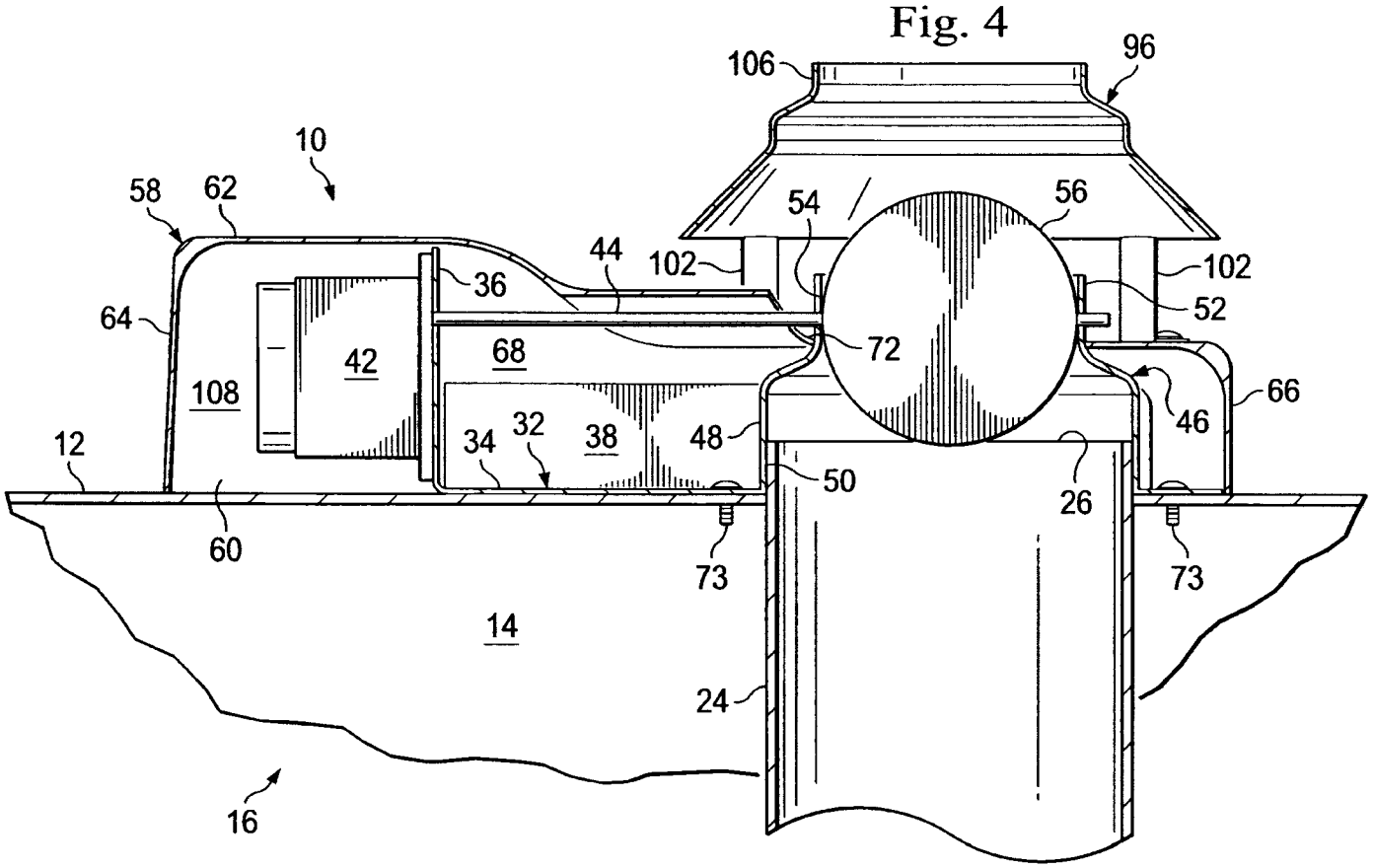
FIG. 4 is an enlarged scale cross-sectional view through the motor/damper assembly taken generally along line 4-4 of FIG. 1.
Figure 5:
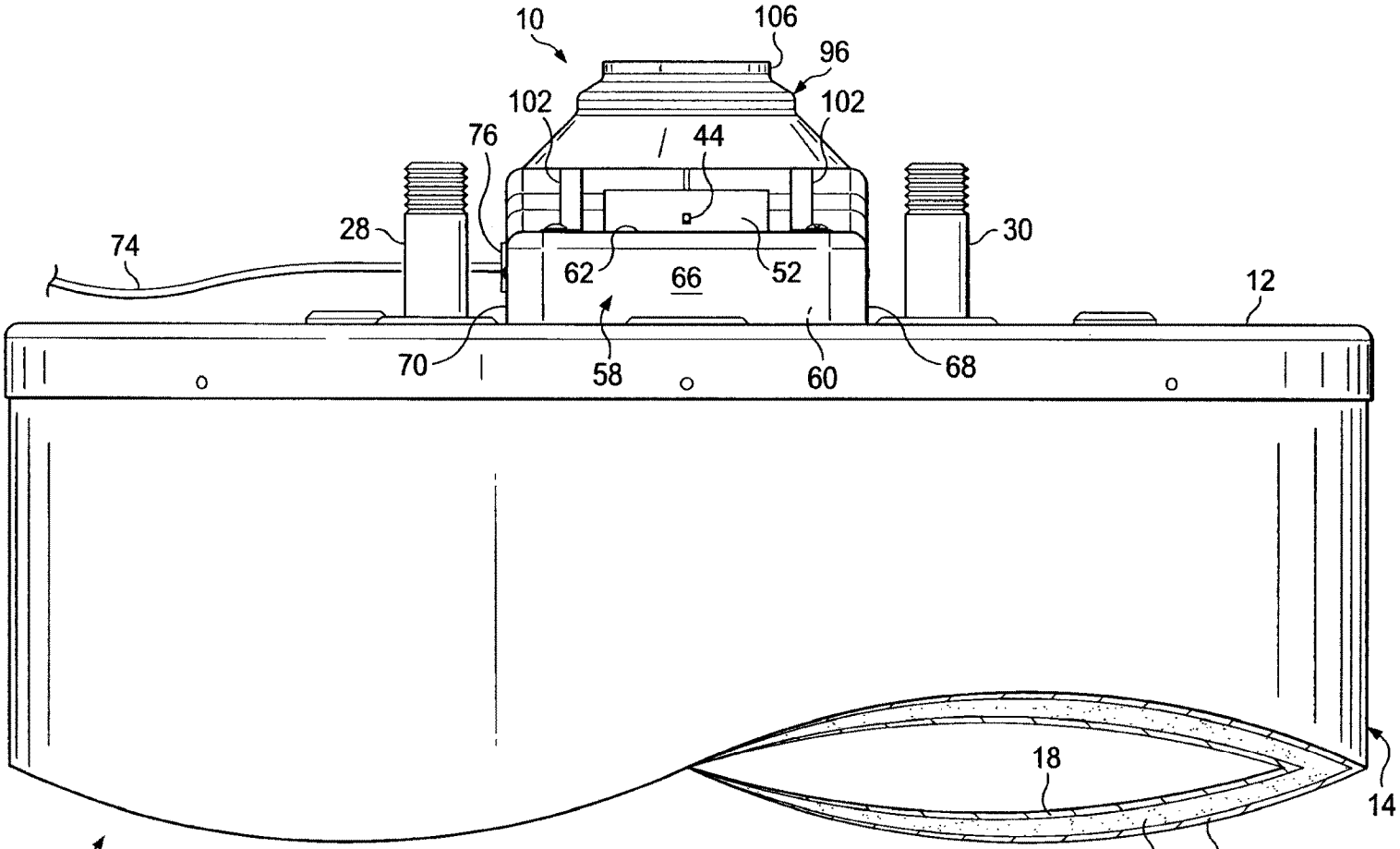
FIG. 5 is a partially cut away side elevational view of the motor/damper assembly, and an upper end portion of the water heater, taken generally along line 5-5 of FIG. 1.

To assemble the motor/damper assembly 10 and operatively secure it to the top end surface 12 of the storage tank portion 16 of the water heater 16, as shown in FIG. 1, the base plate 34 is first placed on the top tank end surface 12 in a manner such that the upper end of the flue 24 is complementarily received in the open lower end portion 48 of the tubular collar 46 as best illustrated in FIG. 4. The base plate 34 is then secured to the top tank end surface 12 using screws 73 (see FIGS. 2-4) extended downwardly through the base plate 34 and threaded into corresponding openings in the top tank end.

Next, an end portion of an electrical power wiring harness 74 is inserted through a an opening (not shown) in the housing 58 side wall 70 and secured to the housing 58 via a suitable strain relief fitting 76. Via a connector 78, the inserted end of the power wiring harness 74 is coupled to a power wiring harness 80 coupled to the motor 42. Additionally, an electrical control wiring harness 82 coupled to the motor 42 is secured, via a connector 84 to an electrical control wiring harness 86 that extends through an opening 88 and associated strain relief fitting 90 in the top end surface 12 and downwardly through the tank insulation 20 to the fuel valve controller of the water heater (not shown).

During operation of the water heater 16, in a generally conventional manner known to those of skill in this particular art, electrical power is transmitted to the motor 42 and the fuel valve controller through the interconnected wiring harnesses 74, 80, 82 and 86, and control signals between the valve controller and the motor 42 are transmitted via the wiring harnesses 82 and 86. Such signals include calls for the damper 56 to open and close, and signals confirming the proper positioning of the damper 56.

After the wiring connections are made to the motor 42 as described above, the housing 58 is placed downwardly over the motor 42 and the support structure 32 in a manner such that the open upper end portion 52 of the tubular collar 46 is complementarily received in and projects upwardly beyond the opening 72 in the top side 44 of the housing 58, and the open bottom side 60 of the housing 58 contacts the top end surface 12 as best shown in FIG. 4. The housing 58 is then anchored to the support plate structure 32 by means of screws 92 (see FIG. 3) extended through the opposite side walls 68,70 of the housing 58 and threaded into openings 94 in the side plates 38,40 of the support plate structure 32.

Finally, a conventional draft hood 96 is secured to the top side 62 of the housing 58, over the upwardly projecting open upper end portion 52 of the tubular collar 46 (see FIG. 4), by extending screws 98 downwardly through bottom ends 100 of depending support leg portions 102 of the draft hood 96 into corresponding holes 104 in the top housing side wall 62. Draft hood 96 has, it its upper end, a circular flange 106 to which a suitable flue pipe extension (not shown) may be secured when the completed water heater 16 is installed at a job site. If desired, the draft hood 96 may be secured to the housing 58 before the housing 58 is installed on the water heater.

With reference now to FIG. 4, it can be seen that the vertically enlarged left end portion of the installed housing 58 defines therein a chamber 108 which protectively encloses the electric motor 42. Other accessories, controls, etc. for the motor/damper assembly 10 (not shown) could also be disposed in this chamber if desired. It should also be noted that the top side wall 62 of the housing 58 protectively overlies and shields (from both view and damage) substantially the entire length of the drive shaft 44.

As previously mentioned herein, the motor/damper assembly 10 provides several advantages over conventional motor/damper assemblies previously utilized in conjunction with fuel-fired water heaters. For example, compared to conventional water heater motor/damper assemblies, the installed assembly 10 is more aesthetically pleasing, with the housing 58 being centered between the cold and hot water pipes 28 and 30 (see FIGS. 1 and 5) and hiding the motor 42 and shaft 44 portions of the assembly. The configuration of the support plate structure 32, coupled with its use of the collar 46, provides a high degree of support rigidity and alignment precision for the motor 42 and the shaft 44 relative to the damper member 56 which substantially eliminates skewing of the damper member resulting in misalignment of and leakage past the damper. Further, the use of the assembly base plate opening 50 that complementarily receives an upper end portion of the flue 24 provides for repeatable precise manufacturing placement of the motor/drive assembly 10 on the top end of the water heater 16. Also, the protective enclosure of the motor 42 and the shaft 44 within the housing 58 substantially reduces the possibility of shipping and handling damage of the shaft 44 which would adversely affect the precise motor/shaft/damper alignment advantageously provided by the use of the motor/damper assembly 10.

The foregoing detailed description is to be clearly understood as being given by way of illustration and example only, the spirit and scope of the present invention being limited solely by the appended claims.

What is claimed is:

1. A motor/damper assembly for a fuel-fired water heater, the motor/damper assembly comprising:

a support plate structure comprising:

a base plate portion formed of a sheet having a planar bottom surface and having an opening extending therethrough sized and shaped to receive a flue extending from a top surface of the water heater, the planar bottom surface of the sheet extending around a complete perimeter of the opening and being shaped and arranged to rest flat on the top surface of the water heater when the flue is extending through the opening, and first and second side support plates connected to opposing sides of the base plate portion and extending substantially perpendicular to the planar bottom surface of the base plate portion; and an open-ended collar extending upwardly from the opening of the base plate portion, the collar being sized and shaped to cooperate with the flue so that combustion exhaust products pass from the flue through the collar when the support plate structure is disposed on the water heater;

a damper member pivotally supported within the collar;

a motor supported by the support plate structure and arranged to rotate the damper member in the collar; and a housing having an open bottom portion shaped to receive and cover the base plate portion, the first and second side support plates, and the motor.

2. The motor/damper assembly of claim 1, wherein the housing is attachable to the first and second side support plates to connect the housing to the support plate structure.

3. The motor/damper assembly of claim 1, wherein the support plate structure comprises a motor support plate connected to and extending substantially perpendicular to the planar bottom surface of the base plate portion, the motor being supported by the support plate structure.

4. The motor/damper assembly of claim 3, wherein the motor support plate comprises an upturned end portion of the base plate portion and the motor is supported on said upturned end portion.

5. The motor/damper assembly of claim 3, further comprising a drive shaft connecting the motor and the damper member, the motor support plate and the collar each comprising an aperture formed therein, the drive shaft extending from the motor through the aperture in the motor support plate and through the aperture in the collar to the damper member.

6. The motor/damper assembly of claim 1, further comprising a drive shaft connecting the motor and the damper member, the housing being disposed above and covering the drive shaft.

7. The motor/damper assembly of claim 1, wherein the housing has a top wall with an opening therein configured to complementarily receive an upper portion of the collar.

8. The motor/damper apparatus of claim 7, further comprising a draft hood structure securable to the top of the housing overlying the collar.

9. The motor/damper assembly of claim 1, wherein the side support plates comprise an upturned end portion of the base plate portion, and the housing is fixedly attached to the side support plates via fasteners.

10. A motor/damper assembly for a fuel-fired water heater, the motor/damper assembly comprising:

a support structure having a base plate portion having an opening extending therethrough sized and shaped to receive a flue extending from a top surface of the water heater, the base plate portion extending around a complete perimeter of the opening and being shaped and arranged to rest on the top surface of the water heater when the flue is extending through the opening;

a housing having an open bottom portion forming a chamber shaped to receive and cover the support structure, the housing being fixedly attachable to the support structure, the housing having an upper portion having an opening therethrough, the opening in the housing being located to overlay the opening in the support structure;

an open-ended collar fixed in place relative to the support structure and extending between the opening of the base plate portion and the opening in the housing, the collar being sized and shaped to cooperate with the flue so that combustion exhaust products pass from the flue through the collar when the motor/damper assembly is disposed on the water heater;

a damper member rotationally supported within the collar; and a motor having an output shaft configured to rotate the damper member within the collar, the motor and the output shaft being disposed within the chamber of the housing, the support structure or housing rigidly fixing the motor in place relative to the collar to provide stability to the output shaft.

11. The motor/damper assembly of claim 10, wherein the base plate portion is formed of a sheet having a planar bottom surface and having an opening extending therethrough, the planar bottom surface being disposed to lie on the top surface of the water heater.

12. The motor/damper assembly of claim 11, wherein the opening in the housing is smaller than the opening in the base plate portion.

13. The motor/damper assembly of claim 12, wherein the collar has a lower portion at the base plate portion with a first diameter and has an upper portion at the housing opening with a second diameter smaller than the first diameter.

14. The motor/damper assembly of claim 10, further comprising a draft hood structure securable to the housing and overlying the collar.

15. The motor/damper assembly of claim 10, wherein the support structure comprises upturned side support plates and the housing is fixedly attached to the side support plates via fasteners.

16. A motor/damper assembly for a fuel-fired water heater, the motor/damper assembly comprising:

a support plate structure comprising:

a base plate portion formed of a sheet having a planar bottom surface and having an opening extending therethrough sized and shaped to receive a flue extending from a top surface of the water heater, the planar bottom surface of the sheet extending around a complete perimeter of the opening and being shaped and arranged to rest flat on the top surface of the water heater when the flue is extending through the opening, and an end plate connected to and extending substantially perpendicular to the base plate portion, the end plate having an aperture extending therethrough, an open-ended collar connected to and extending only upwardly from the base plate portion, the collar being sized and shaped to cooperate with the flue so that combustion exhaust products that pass through said opening also pass through said collar;

a damper member pivotally supported within said collar; and a motor supported above the top surface of the water heater radially in line with the end plate and having an output shaft extending through the aperture of the end plate, over a portion of the sheet forming the base plate portion, and into the collar to drive rotation of the damper member relative to the collar.

17. The motor/damper assembly of claim 16, further comprising a housing having an open bottom portion forming a chamber shaped to receive and cover the support plate structure, the housing being fixedly attachable to the support plate structure, and having an upper portion with an opening therethrough, the opening in the housing being located to overlay the opening in the support structure.

18. The motor/damper assembly of claim 17, further comprising a draft hood structure securable to the housing and overlying the collar.

19. The motor/damper assembly of claim 17, wherein the support plate structure comprises upturned side support plates and the housing is fixedly attached to the side support plates via fasteners.

20. The motor/damper assembly of claim 16, wherein the opening in the housing is smaller than the opening in the base plate portion.

* * * * *